US008337158B1

(12) United States Patent
Liang

(10) Patent No.: US 8,337,158 B1
(45) Date of Patent: Dec. 25, 2012

(54) TURBINE BLADE WITH TIP CAP

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 734 days.

(21) Appl. No.: 12/604,199

(22) Filed: Oct. 22, 2009

(51) Int. Cl.
*F01D 5/18* (2006.01)

(52) U.S. Cl. ..... 416/97 R; 415/115; 29/889.1

(58) Field of Classification Search ..... 415/115, 415/173.6; 416/96 R, 97 R, 96 A, 92; 29/889.1
See application file for complete search history.

(56) References Cited

U.S. PATENT DOCUMENTS 4,411,597 A * 10/1983 Koffel et al. ..... 416/92
7,568,882 B2 * 8/2009 Brittingham et al. ..... 415/1
7,713,026 B1 * 5/2010 Liang ..... 416/1
8,096,767 B1 * 1/2012 Liang ..... 416/97 R
8,096,772 B2 * 1/2012 Liang ..... 416/97 R

* cited by examiner

*Primary Examiner* — Igor Kershteyn
*Assistant Examiner* — Jesse Prager
(74) *Attorney, Agent, or Firm* — John Ryznic

(57) ABSTRACT

A turbine rotor blade with a tip cap section bonded to a tip end of the blade airfoil section, the tip cap section forming a separate cooling passage for the blade tip with a series of impingement chambers and diffusion chambers extending from a leading edge cooling air supply channel to a trailing edge exist hole. The chambers are formed by slanted ribs and a thin thermal skin is bonded to the ribs and upper and bottom surfaces to form an airfoil surface for the tip cap section. a blade with a damaged tip section can be repaired by removing the damaged section and bonding a tip cap section to the remaining surface of the blade to form a reusable rotor blade.

19 Claims, 2 Drawing Sheets

TURBINE BLADE WITH TIP CAP

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade tip cap.

2. Description of the Related Art Including Information Disclosed Under 37 CFR 1.97 and 1.98

A gas turbine engine includes a turbine with multiple rows or stages of rotor blades and stator vanes to guide a hot gas flow through and extract mechanical energy to drive the compressor or even an electric generator in the case of an industrial gas turbine (IGT) engine. The efficiency of the engine can be increased by passing a higher gas flow temperature through the turbine. However, the turbine inlet temperature is limited to the material properties of the turbine vanes and blades and to the amount of cooling provided to these airfoils.

Another problem with turbine a turbine, especially the IGT engine, is that the rotor blades have tips that form a seal with an outer shroud of the turbine casing to create a blade outer air seal (or, BOAS) to limit hot gas flow leakage across the blade tip gaps. The blade tip gap can vary in size due to engine thermal loads and engine transient conditions. Blade tips can also rub against the shroud surface such that the gap is zero. Blade rub can sometimes be beneficial when proper design for blade tip rub is accounted for. However, hot gas flow leakage across the blade tip gap will result in not only lower turbine efficiency but also hot spots on the tips that result in erosion of tip material that limits the blade life. An IGT engine can operate continuously for over 40,000 hours so blade tip erosion can cause serious problems. An engine shutdown could even be required which will cause further problems with the engine operator. Thus, blade tip cooling is an important design objective for a rotor blade in a gas turbine engine, especially for an IGT engine.

When a blade tip of a turbine rotor blade is damaged, the entire blade must be replaced. A typical rotor blade can have a squealer pocket formed on the tip in which tip rails extend around the periphery of the blade tip along the pressure side wall and the suction side wall and joined around the leading edge wall. The tip rails provide for a small surface area for tip rub as well as a seal against the outer shroud surface.

BRIEF SUMMARY OF THE INVENTION

It is an object of the present invention to provide for a turbine rotor blade with a tip section that provides for cooling of the blade tip to allow for long blade life.

It is another object of the present invention to provide for a turbine rotor blade with a reduced airfoil through wall thermal gradient and metal temperature for improved blade life or reduced blade tip cooling flow requirement.

It is another object of the present invention to provide for a turbine rotor blade in which a damaged tip section can be repaired so that the blade can be used again.

The above objective and more are achieved with the turbine rotor blade of the present invention in which the blade includes a blade tip section that can be bonded to the blade to form the entire blade with tip and tip cooling circuit. The blade tip includes a lower surface and an upper surface that forms a cooling air passage from the leading edge to the trailing edge to provide cooling for the blade tip. The blade tip passage includes a zig zag arrangement of ribs that extend across the blade tip passage from the pressure side wall to the suction side wall to form an alternating series of impingement chambers followed by diffusion cavities.

Cooling air is supplied through a leading edge cooling supply cavity to the first impingement cavity in the blade to provide impingement cooling to the upper wall that forms the squealer pocket floor of the blade tip. The spent impingement cooling air passes into a diffusion chamber and then through a second row of impingement holes to provide impingement cooling to the next section of the tip floor. this series of impingement cooling followed by diffusion collection of the spent cooling air continues along the blade tip and ends at the trailing edge of the blade tip where the cooling air is discharged out through a trailing edge exit hole. A row of tip periphery cooling holes can be arranged along the pressure side wall or the suction side wall and connected to the blade tip cooling passage to also provide film cooling to the blade tip periphery.

In a blade with a damaged blade tip section, the damaged tip section can be removed and the blade tip section of the present invention can be bonded to the blade to form a new tip section so that the damaged blade can be reused. The damaged blade can be machined to remove enough material so that a smooth surface can be left to bond the new tip section to the blade tip end surface. Alternatively, a new blade can be formed with the blade tip section of the present invention already formed onto the blade to provide improved cooling for the blade tip so that the blade life can be extended.

DETAILED DESCRIPTION OF THE INVENTION

Figure 1:
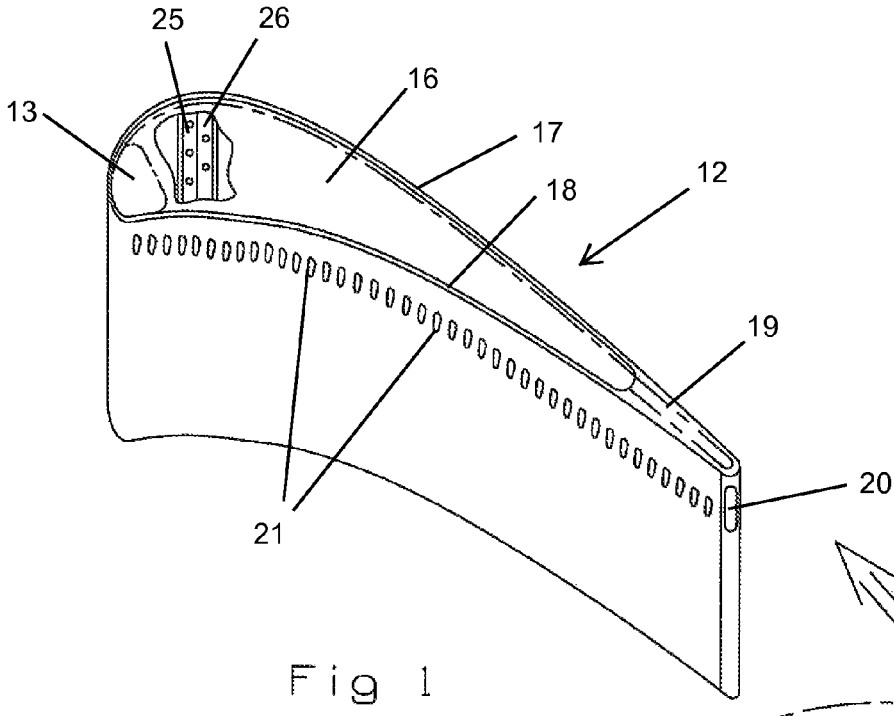
FIG. 1 shows an isomeric view of the blade tip of the present invention.

The present invention is a blade tip cap for a turbine rotor blade, especially for an IGT engine rotor blade that requires long service life when compared to an aero engine rotor blade. However, the blade tip cap can also be used in an aero engine. FIG. 1 shows an isometric view of the blade tip section of the blade 10 with the blade tip cap of the present invention. The blade tip cap section 12 is formed on the tip end of an airfoil section 11 of the blade. The blade tip cap section 12 includes a pressure side wall with a row of film cooling holes 21 extending from the leading edge section to the trailing edge section of the airfoil. the blade tip section includes a squealer pocket 18 formed by tip rails 16 and 17 on the suction wall side and the pressure wall side and extends around the leading edge to form a continuous tip rail from the leading edge and around the leading edge of the airfoil. A leading edge cooling air supply channel 13 provide cooling air for the tip cap section. A trailing edge region hole 19 connects the tip cap cooling passage to an exit hole 20 that opens onto the trailing edge. A breakaway section in the leading edge region shows a row of impingement holes 25 in an impingement rib and a row of spent air return holes 26 in a diffusion rib. The number of impingement holes 25 used in each slanted rib will depend upon the surface area to be cooled by impingement and the amount of impingement cooling air discharged. The return holes 26 can have a larger diameter than the impingement holes 25 and can also be less numerous. The tip cap section 12 of the present invention is ready to be secured to a tip end of the blade to form the blade tip.

Figure 2:
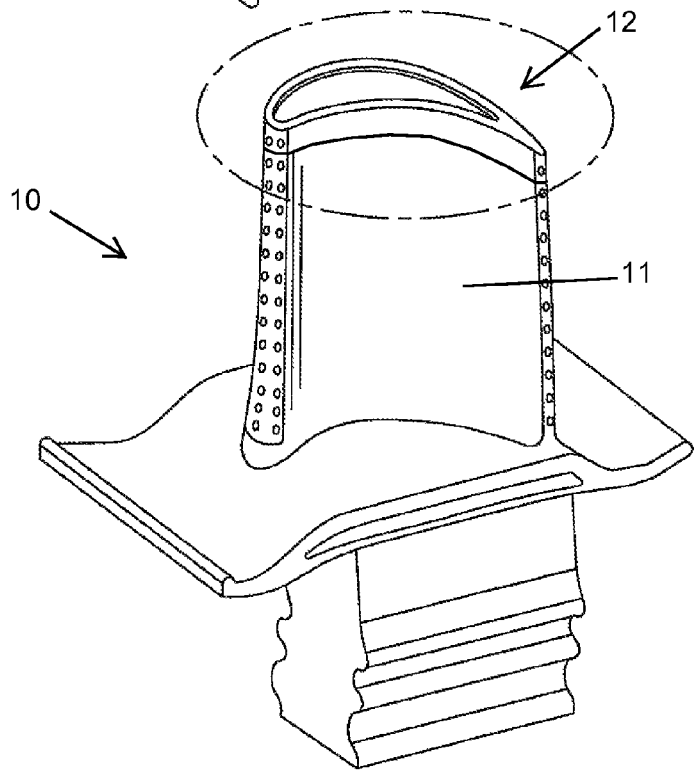
FIG. 2 shows an isometric view of a turbine rotor blade with the blade tip section of FIG. 1.

FIG. 2 shows the blade 10 with the blade tip section 12 secured onto the tip end of the airfoil section 11 to form the entire turbine rotor blade. The blade includes a showerhead arrangement of film cooling holes on the leading edge region and a row of exit holes along the trailing edge of the blade. The row of exit holes could be exit slots that open onto the pressure side wall of the trailing edge region. The trailing edge (T/E) exit holes or slots extend along the airfoil from the platform to the blade tip. The blade tip cap section 12 includes one exit hole aligned with the other exit holes formed in the airfoil section 11 but is used to discharge the spent cooling air from the tip cap section cooling passage or channel that extends from the leading edge to the trailing edge.

Figure 3:
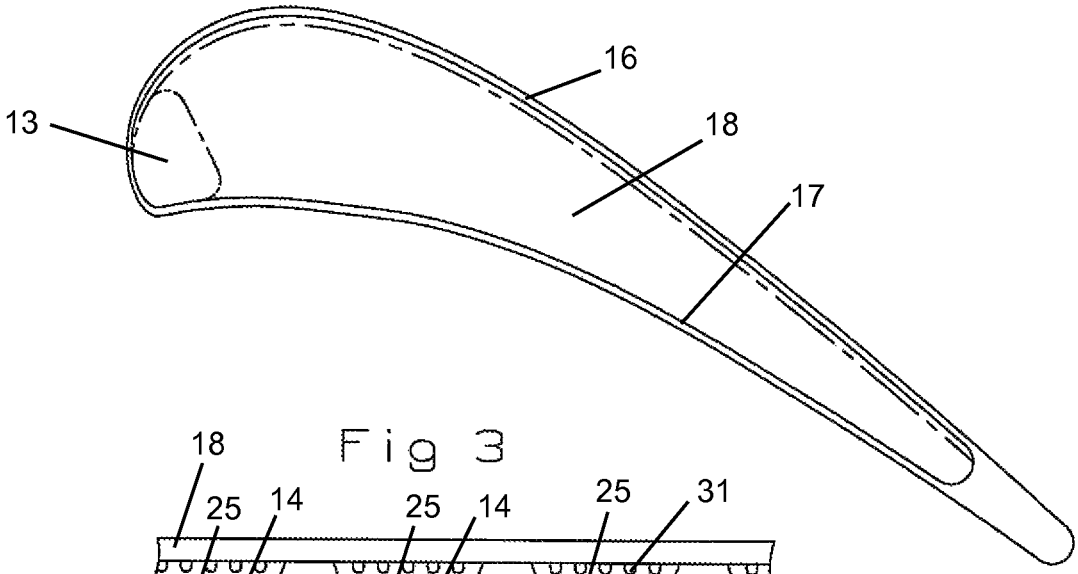
FIG. 3 shows a cross section top view of the blade tip of the present invention.

FIG. 3 shows a cross section top view of the blade tip with the squealer pocket floor 18 formed between the suction side (S/S) tip rail 16 and the pressure side (P/S) tip rail 17. The cooling air supply channel 13 is shown along the leading edge of the blade and supplies the cooling air for the tip cap section cooling passage.

Figure 4:
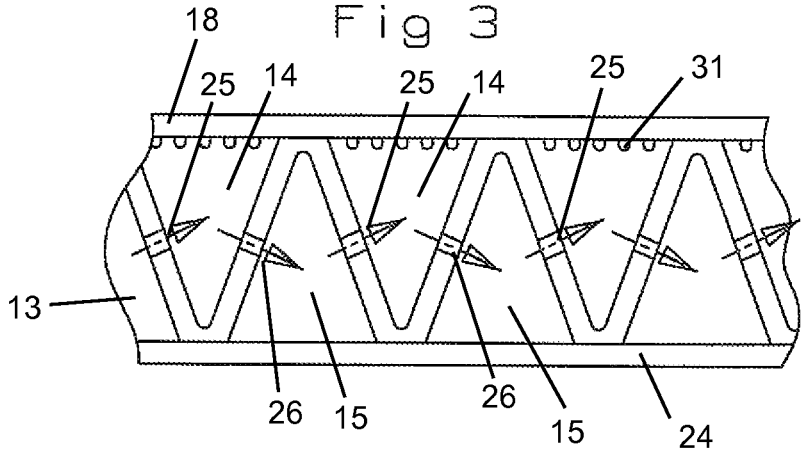
FIG. 4 shows a cross section view from the side of the blade tip cooling passage with the impingement chambers alternating between the diffusion chambers.

FIG. 4 shows a section of the blade tip cooling passage from the side view with the leading edge cooling air supply channel 13 on the forward end. The blade tip cap 12 is formed by an upper surface 18 that also forms the squealer pocket floor and a bottom surface 24 that forms a bonding surface to secure the tip cap 12 to the tip end of the blade airfoil 11. The tip cap 12 includes a series of slanted ribs that extend across the tip cap cooling channel from the P/S wall to the S/S wall to form the impingement chambers 14 and the diffusion chambers 15. A row of impingement holes 25 are formed in the impingement ribs that open into the diffusion chambers 15. The impingement holes 25 are also metering holes in that the amount of cooling air and the pressure can be metered by varying the diameter. A row of return holes 26 is formed in the diffusion ribs and open into the diffusion chambers 15. As seen in FIG. 4, the impingement chambers alternate with the diffusion chambers in the chordwise direction of the blade tip from the leading edge cooling air supply channel 13 to the T/E region of the blade tip.

The impingement ribs are slanted upward in the direction of the cooling air flow so that the metering holes 25 will direct the impingement cooling air up against the underside of the tip floor surface 18 to provide impingement cooling for the blade tip. The diffusion ribs are slanted downward in the direction of the cooling air flow and into the diffusion chambers 15. Micro pin fins 31 are formed along the inner surface of the upper wall 18 to enhance the impingement cooling effect. The outer most metering holes 25 in each slanted rib is directed to discharge the impingement cooling air more toward the thermal skin that forms the airfoil surface of the tip cap section 12 to provide impingement cooling to the backside wall surface of the thermal skin airfoil surface.

Figure 5:
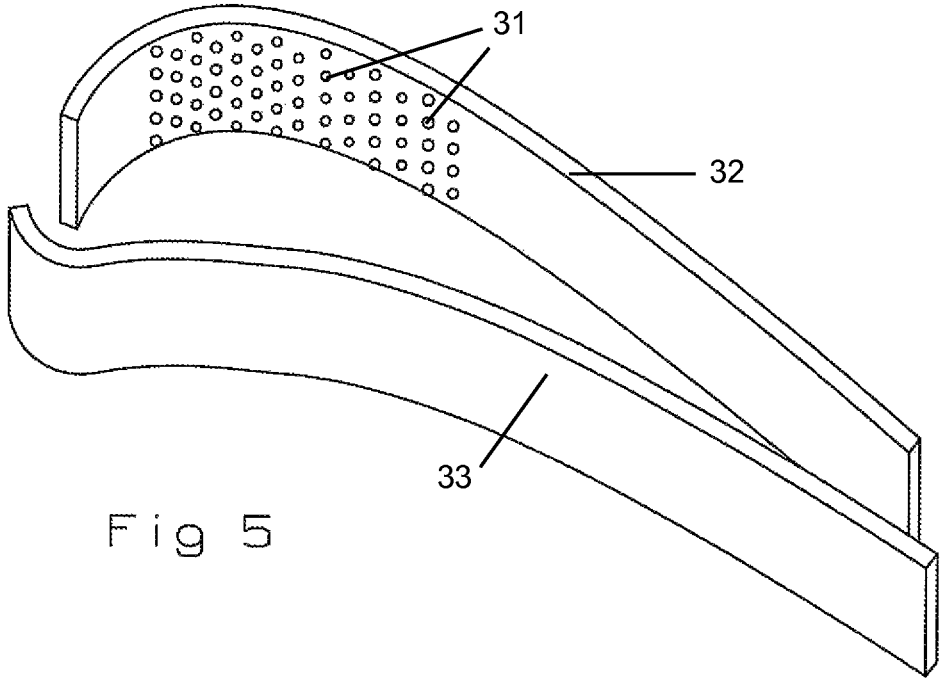
FIG. 5 shows an isometric view of a pressure side wall and a suction side wall of the blade tip formed from a thin thermal skin with micro pin fins on the inner side surface.

The fully enclose the blade tip cap section 12, a thin thermal skin is bonded to the sides to form the pressure and suction side walls as well as the leading edge wall of the blade tip. FIG. 5 shows an embodiment in which two sections of a thin thermal skin are bonded to form the airfoil surface of the tip cap section 12. a S/S wall 32 for the airfoil tip cap section includes micro pin fins 31 formed on the inner side is bonded to the suction wall side of the blade tip cap section from the upper surface 18 to the bottom surface 24 to fully enclose the tip cap section cooling passage. A P/S wall 33 forms the P/S airfoil surface for the tip cap section 12 and extends along the P/S wall. the two thin thermal skin sections 32 and 33 abut along the leading edge section to form a complete airfoil surface that extends to the T/E. in other embodiments, the thin thermal skin can be formed of more than two sections or from a single section that wraps around the L/E and extends along both sides of the airfoil. Micro pin fins 31 are also formed on the inner side of the P/S thin thermal skin 33.

A row of film cooling holes can be connected to the tip cap section cooling passage that opens onto the airfoil surface of the tip cap section on the pressure wall side and/or the suction wall side to discharge film cooling air onto these sections of the tip cap airfoil surface.

In constructing the blade tip cap 12 with the micro pin fins 31 on the thermal skin, the blade tip cap spar (the spar is the blade tip cap without the thin thermal skin that forms the airfoil surface) can be cast with a built in leading edge cooling supply channel 13. Multiple impingement cooling holes can then be machined into the slanted ribs of each of the impingement and diffusion chambers 14 and 15. The end cap spar can be formed from a different material than the thermal skin with built in back side micro pin fins 31 or form the same material. The thermal skin or skins is bonded to the tip cap spar using a transient liquid phase (TLP) bonding process. The thin thermal skin can be formed from multiple pieces or a single piece and from a high temperature material compared to the blade tip cap section and from a thin sheet of metal. The micro pin fins 31 can be formed by photo etching or chemical etching onto the backside surface of the thermal skin. The thickness for the thermal skin after etching can be in the range of 0.010 to 0.030 inches. The micro pin fin 31 diameter and height will be around the same as the thickness of the thermal skin. The density for the micro pin pins 31 can be in the range of 50% to 75%. A low conductivity TBC material can be secured to the thermal skin external surface for further reduction of heat flux onto the airfoil external wall of the blade tip section.

In operation, the cooling air is supplied through the leading edge cooling supply channel 13 and then into the first impingement chamber 14 through a row of the metering holes 25 to produce impingement cooling of the inner side of the upper wall of the tip cap floor in that region of the tip cap. The outermost impingement cooling holes along the slanted ribs discharges the impingement cooling air mostly onto the backside surface of the thermal skin that forms the airfoil surface of the tip cap section to provide impingement cooling to the airfoil walls. The spent cooling air then flows through the row of return holes 26 and into the adjacent diffusion chamber 15 where the spent cooling air is diffused and collected, and then passed through the next row of metering holes 25 and into the impingement chamber to produce impingement cooling to the next section of the blade tip floor. The impingement cooling air impinges onto the surface with the micro pin fins 31 to enhance the backside convective cooling. This series of impingement cooling of the backside wall of the tip floor followed by diffusion and collection of the spent cooling air continues along the entire tip cap section cooling passage until the spent cooling air is discharged through the T/E exit hole 20. This produces a multiple impingement cooling process for the blade tip cap section. If a row of film cooling holes are used on the tip periphery of the tip cap walls, then some of the cooling air flowing through the tip cap cooling passage will be discharged through the row or rows of film holes to provide additional cooling to the external surface of the blade tip cap section. The multiple impingement and diffusion process is performed from the blade leading edge toward the blade trailing edge in the tip cap section to fully utilize the pressure potential between the cooling supply pressure to the gas side main stream pressure for cooling of the tip cap section.

By regulating the impingement pressure ratio across the metering holes, each individual chamber can be designed based on the blade tip section gas side pressure distribution in the chordwise direction. Also, each individual chamber can be designed based on the blade tip section local external heat load to achieve a desired local metal temperature. With the structure and process of the present invention, a maximum use of the cooling air for a given airfoil inlet gas temperature and pressure profile can be achieved. also, multiple metering and diffusion cooling design utilizes the multiple impingement cooling process for the backside convection cooling as well as flow metering with the spent cooling air discharged onto the blade tip section along the pressure and suction side walls to form a peripheral film cooling array at a very high film coverage with some of the spent cooling air being discharged through the airfoil trailing edge to provide cooling to this section of the tip cap section. this combination of multiple impingement cooling against the backside of the tip floor with heat transfer enhanced micro pin fins and/or multiple rows of film cooling holes on the peripheral side walls will yield a very high cooling effectiveness and a uniform wall temperature for the airfoil wall. Also, a rotor blade with a damaged tip section can be repaired by removing the blade tip section so that the tip cap section of the present invention can be secured to the remaining blade tip end so that the blade can be reused but with improved blade tip cooling capability.

I claim the following:

1. A turbine rotor blade comprising:

an airfoil section extending from a platform and root section;

a blade tip cap section secured to a tip end of the airfoil section to form a complete blade;

the blade tip cap section having an upper surface forming a blade tip floor and a bottom surface that forms a surface to secure the tip cap section to the airfoil section;

the upper surface and the bottom surface form a tip cap section cooling air passage extending from a leading edge section to a trailing edge section;

the tip cap section cooling air passage having a series of alternating impingement chambers with impingement holes and diffusion chambers with return holes; and, the impingement chambers each includes a row of impingement cooling holes directed to discharge impingement cooling air onto a backside surface of the upper surface.

2. The turbine rotor blade of claim 1, and further comprising:

the blade tip cap section is formed as a tip cap section spar; and, a thin thermal skin bonded to the tip cap section spar to form an airfoil surface for the blade tip cap section.

3. The turbine rotor blade of claim 1, and further comprising:

the upper surface includes an array of micro pin fins to enhance a heat transfer effect of the impingement cooling air discharged from the impingement cooling holes.

4. The turbine rotor blade of claim 2, and further comprising:

the thin thermal skin includes an array of micro pin fins on the backside surface to enhance a heat transfer coefficient of the thin thermal skin.

5. The turbine rotor blade of claim 2, and further comprising:

the thin thermal skin encloses the tip cap section cooling passage with the upper surface and the bottom surface.

6. The turbine rotor blade of claim 1, and further comprising:

a cooling air supply channel is located in the leading edge region of the airfoil and supplies cooling air to a first impingement chamber through a row of first metering holes.

7. The turbine rotor blade of claim 1, and further comprising:

a exit hole opening onto a trailing edge of the tip cap section and connected to a last diffusion chamber of the tip cap section cooling passage.

8. The turbine rotor blade of claim 2, and further comprising:

a row of film cooling holes in the thin thermal skin and connected to the tip cap section cooling air passage to discharge film cooling air.

9. The turbine rotor blade of claim 1, and further comprising:

the holes on the two ends of the row of impingement cooling holes are directed to discharge impingement cooling air against the airfoil walls.

10. A tip cap section for a turbine rotor blade comprising:

an upper surface that forms a floor for a tip of the blade;

a bottom surface that forms a bonding surface to secure the tip cap section to a surface of an airfoil section of the blade;

a series of alternating slanted ribs extending across the tip cap section from a pressure side to a suction side and forming an alternating series of impingement chambers and diffusion chambers;

a row of metering holes in the slanted ribs that open into the impingement chambers;

a row of return holes in the slanted ribs that open into the diffusion chambers; and, a thin thermal skin bonded to the tip cap section to enclose the tip cap section cooling passage from a leading edge region to a trailing edge region.

11. The tip cap section of claim 10, and further comprising:

a leading edge cooling air supply channel connected to a first impingement chamber to supply impingement cooling air to a first row of metering holes.

12. The tip cap section of claim 10, and further comprising:

a exit hole located along the trailing edge of the tip cap section and connected to a last diffusion chamber.

13. The tip cap section of claim 10, and further comprising:

a row of film cooling holes in the thin thermal skin to discharge film cooling air from the tip cap section cooling passage.

14. The tip cap section of claim 10, and further comprising:

the upper surface includes an array of micro pin fins facing the impingement chambers.

15. The tip cap section of claim 10, and further comprising:

the thin thermal skin is made from a higher temperature resistant material than the tip cap section spar that the thermal skin is bonded to.

16. The tip cap section of claim 10, and further comprising:

the metering holes on the two ends of the row of metering holes are directed to discharge impingement cooling air against the airfoil walls.

17. A process for repairing a turbine rotor blade with a damaged blade tip comprising the steps of:

removing a section of the blade tip that contains the damaged section; and, securing the blade tip cap section of claim 10 to the remaining section of the blade to form reusable blade.

18. The process for repairing a turbine rotor blade of claim 17, and further comprising the step of:

forming a flat surface on the tip end of the blade having the removed damaged part, the flat surface forming a bonding surface for the blade tip cap section.

19. The process for repairing a turbine rotor blade of claim 17, and further comprising the step of:

using a transient liquid phase bonding process to bond the blade tip cap section to the remaining surface of the blade.

* * * * *